US007639976B2

(12) United States Patent
Yoshida

(10) Patent No.: US 7,639,976 B2
(45) Date of Patent: Dec. 29, 2009

(54) IMAGE FORMING APPARATUS

(75) Inventor: Ken Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 282 days.

(21) Appl. No.: 11/749,432

(22) Filed: May 16, 2007

(65) Prior Publication Data

US 2007/0280748 A1 Dec. 6, 2007

(30) Foreign Application Priority Data

May 30, 2006 (JP) ..... 2006-150301

(51) Int. Cl.
*G03G 15/16* (2006.01)

(52) U.S. Cl. ..... 399/302

(58) Field of Classification Search ..... 399/302, 399/308, 66

See application file for complete search history.

(56) References Cited

U.S. PATENT DOCUMENTS

| | | | | |
|---|---|---|---|---|
| 6,654,574 | B2 * | 11/2003 | Kayahara et al. | 399/302 |
| 7,003,238 | B2 | 2/2006 | Yoshida et al. | |
| 2004/0179860 | A1 | 9/2004 | Watanabe et al. | |
| 2009/0136270 | A1 * | 5/2009 | Yamada | 399/308 |

FOREIGN PATENT DOCUMENTS

| | | | |
|---|---|---|---|
| EP | 1 424 608 | A2 | 6/2004 |
| JP | 3-100661 | | 4/1991 |
| JP | 7-152202 | | 6/1995 |
| JP | 9-319134 | | 12/1997 |
| JP | 11-149179 | | 6/1999 |
| JP | 3056122 | | 4/2000 |
| JP | 3328013 | | 7/2002 |
| JP | 3344792 | | 8/2002 |
| JP | 2003-76163 | | 3/2003 |
| JP | 3449122 | | 7/2003 |
| JP | 2005-284275 | | 10/2005 |

OTHER PUBLICATIONS

U.S. Appl. No. 12/119,050, filed May 12, 2008, Muto et al.

* cited by examiner

*Primary Examiner*—Susan S Lee
(74) *Attorney, Agent, or Firm*—Oblon, Spivak, McClelland, Maier & Neustadt, L.L.P.

(57) ABSTRACT

An image forming apparatus includes an image carrier that carries toner images, and an intermediate transfer member onto which the toner images are primarily transferred, sequentially from a first toner image, from the image carrier. A primary transfer bias applied upon primary transfer of the first toner image is higher than a primary transfer bias applied upon primary transfer of other toner images. The intermediate transfer member has a surface potential attenuation ratio such that residual potential of the intermediate transfer member applied with a voltage of 500 volts becomes equal to or lower than 250 volts after five seconds.

10 Claims, 4 Drawing Sheets

IMAGE FORMING APPARATUS

CROSS-REFERENCE TO RELATED APPLICATIONS

The present document incorporates by reference the entire contents of Japanese priority document, 2006-150301 filed in Japan on May 30, 2006.

BACKGROUND OF THE INVENTION

1. Field of the Invention

The present invention relates to an image forming apparatus.

2. Description of the Related Art

Image forming apparatuses of intermediate transfer type have been known in which toner images sequentially formed on a photosensitive member as an image carrier are sequentially superposed on an intermediate transfer belt as an intermediate transfer belt for intermediate transfer and these toner images on the intermediate transfer belt are then collectively transferred onto a transfer member for secondary transfer. In the case of a color image forming apparatus of this intermediate transfer type, toner images of different colors are transferred sequentially onto the intermediate transfer belt and superposed one on another, thereby forming a color toner image. Therefore, the toner images on the intermediate transfer belt have to pass through a primary transfer nip repeatedly. While the toner images are passing through the primary transfer nip repeatedly in this manner, so-called reverse transfer occurs, in which the toner is reversely charged and transferred onto the photosensitive member. With the occurrence of such reverse transfer, the toner of a solid image is partially decreased, which causes irregularity in the image.

To get around this problem, in one scheme, test pattern images of respective colors are formed on the intermediate transfer belt and the amount of adhered toner is detected for each test pattern image on the intermediate transfer belt after primary transfer of the test pattern images of all colors. Then, image parameters, such as a development bias for each color, are adjusted so that the amount of adhered toner for each color on the intermediate transfer belt after primary transfer of toner images of all colors is to be a predetermined amount. With this, the amount of adhered toner of a toner image for each color formed on the photosensitive member is increased by the amount of toner lost from the intermediate transfer belt due to reverse transfer. Therefore, even if the amount of adhered toner reduces due to reverse transfer, the amount of adhered toner for each color on the intermediate transfer belt after primary transfer of the toner images of all colors can be adjusted to the predetermined amount, which suppresses irregularity in an image. In this case, however, toner consumption increases, resulting in a higher cost for toner.

Japanese Patent No. 3344792 discloses a technology in which the toner on the intermediate transfer belt is charged again by a corona discharger before the toner on the intermediate transfer belt reaches the next primary transfer nip. With this, even if the toner on the intermediate transfer belt is reversely charged while passing through the primary transfer nip and the amount of charge decreases, the toner is charged again before reaching the next primary transfer nip. As a result, reverse charge of the toner on the intermediate transfer belt at the primary transfer nip can be suppressed, which prevents reverse transfer of the toner on the intermediate transfer belt at the primary transfer nip.

However, it is required to provide the corona discharger for charging again the toner on the intermediate transfer belt, which increases the cost, size, and power consumption of the apparatus. In particular, in the case of a tandem-type image forming apparatus including a plurality of photosensitive members, a corona discharger is provided at each portion between primary transfer nips, whereby increase in the cost, the size, and the power consumption is more significant.

Japanese Patent Application Laid-Open No. 2005-284275 discloses a technology in which the amount of adhered toner of a color (magenta M) to be first transferred onto the intermediate transfer belt after primary transfer of toner images of all colors is detected. If the amount of reverse transfer of the M-color toner exceeds a predetermined amount, a primary transfer bias (primary transfer current) for other colors (yellow Y, cyan C, and black Bk) is reduced by a predetermined value. In this manner, the second primary transfer bias onward is decreased, which suppresses the charging of the M-color toner on the intermediate transfer belt to reduce the amount of M-color toner of reverse charge. With this, the amount of M-color toner of reverse transfer can be reduced. Also, because an apparatus that charges the toner again, such as a corona discharger, is not used, it is possible to suppress an increase in cost and size of the apparatus. Furthermore, power consumption can be reduced, resulting in saving of energy.

However, in successive printing, if the primary transfer bias of the second color onward is reduced, primary transferability of the toner image of the second color onward is decreased after a predetermined number of printings, which causes an erroneous image with color unevenness.

The reason for this is explained below. At the primary transfer nip, a primary transfer bias having a polarity reverse to that of the toner is applied to the back surface of the intermediate transfer belt to form a primary transfer electric field. Therefore, when the intermediate transfer belt passes through the primary transfer nip, charges having the same polarity as that of the toner are moved onto the surface of the intermediate transfer belt due to an influence of the primary transfer electric field, and the charges having the polarity reverse to that of the toner are moved onto the back surface of the intermediate transfer belt. Thus, the surface of the belt is charged. If potential attenuation of the belt is not sufficient, the surface potential of the intermediate transfer member increased due to the primary transfer electric field cannot be attenuated by itself through the inside of the intermediate transfer belt even if the intermediate transfer belt rotates once after the toner image is transferred onto a transfer sheet for secondary transfer, and charges are left on the surface of the intermediate transfer member. As a result, when successive printing is performed, the potential of the intermediate transfer belt gradually increases. With an influence of the surface potential of the intermediate transfer belt, the primary transfer electric field acting on the transfer nip is weakened. As a result, for the second color onward in which the primary transfer bias is decreased to weaken the transfer electric field, the primary transfer electric field is further weakened. With this, primary transferability of the toner images of the second color onward decreases after a predetermined number of printings when successive printing is performed.

Moreover, if the potential attenuation of the belt is low, the potential history of the previous image is left on the surface of the intermediate transfer belt and a residual image of the toner at the time of the previous image formation occurs on the toner image transferred onto a recording medium for secondary transfer at the time of the next image formation.

SUMMARY OF THE INVENTION

It is an object of the present invention to at least partially solve the problems in the conventional technology.

According to an aspect of the present invention, an image forming apparatus includes an image carrier that carries toner images, and an intermediate transfer member onto which the toner images are primarily transferred, sequentially from a first toner image, from the image carrier to form a superposed toner image to be secondarily transferred onto a transfer member. The intermediate transfer member is applied with different levels of primary transfer bias upon primary transfer of the toner images. A level of primary transfer bias applied upon primary transfer of the first toner image is higher than a level of primary transfer bias applied upon primary transfer of other toner images. The intermediate transfer member has a surface potential attenuation ratio such that residual potential of the intermediate transfer member applied with a voltage of 500 volts becomes equal to or lower than 250 volts after five seconds.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
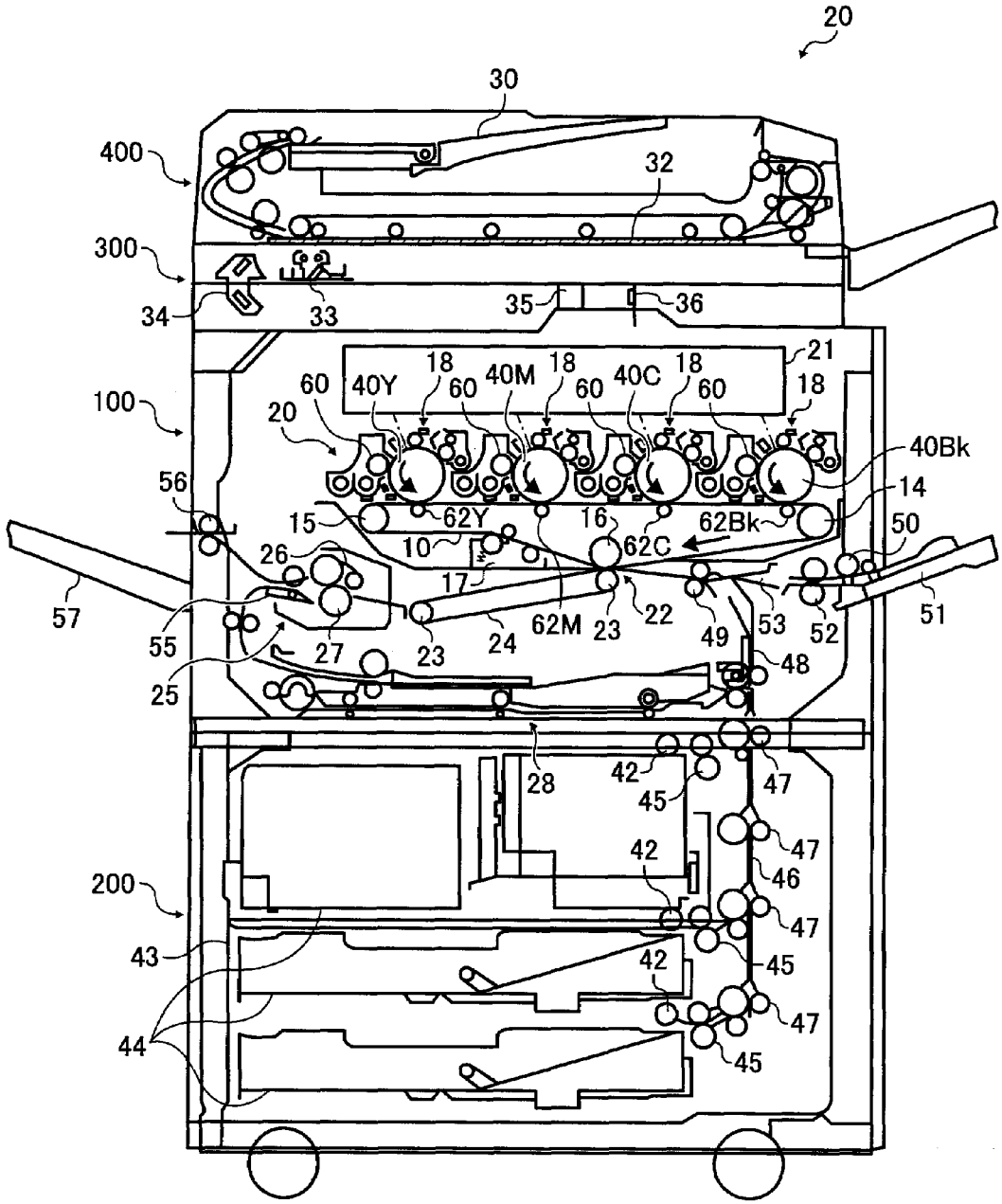
FIG. 1 is a schematic diagram of an image forming apparatus according to an embodiment of the present invention.

FIG. 1 is a schematic diagram of an image forming apparatus 20 according to an embodiment of the present invention. The image forming apparatus 20 is, for example, an electrophotographic color copier of a tandem-type indirect transfer scheme. The image forming apparatus 20 includes a copier body 100, a feeding table 200 on which the copier body 100 is mounted, a scanner 300 mounted on the copier body 100, and an automatic document feeder (ADF) 400 mounted further thereon.

The copier body 100 is provided with an intermediate transfer belt 10 as an endless-belt-shape intermediate transfer member in the center. The intermediate transfer belt 10 extends around three supporting rollers 14, 15, and 16 for allowing rotational conveyance in a clockwise direction in FIG. 1.

An intermediate-transfer-belt cleaning device 17 that removes residual toner left on the intermediate transfer belt 10 after image transfer is provided on the surface of the intermediate transfer belt 10 stretched between the second and third supporting rollers 15 and 16 among the three supporting rollers 14, 15, and 16.

On the intermediate transfer belt 10 stretched over the first and second supporting rollers 14 and 15 among the three supporting rollers 14, 15, and 16, the image forming apparatus 20 includes four image forming units 18Y, 18M, 18C, and 18Bk of yellow, magenta, cyan, and black. The image forming units 18Y, 18M, 18C, and 18Bk are horizontally aligned along a conveyance direction. The image forming apparatus 20 further includes an exposing device 21.

The image forming units 18Y, 18M, 18C, and 18Bk include photosensitive drums 40Y, 40M, 40C, and 40Bk, respectively, as image carriers that carry toner images of yellow, magenta, cyan, and black. Also, at each primary transfer position where a toner image is transferred onto the intermediate transfer belt 10 from relevant one of the photosensitive drums 40Y, 40M, 40C, and 40Bk, relevant one of primary transfer rollers 62Y, 62M, 62C, and 62Bk is arranged as a component of a primary transfer unit to face relevant one of the photosensitive drums 40Y, 40M, 40C, and 40Bk via the intermediate transfer belt 10. The supporting roller 14 is a driving roller that drives the intermediate transfer belt 10 for rotation. When a black single-color image is to be formed on the intermediate transfer belt, the supporting rollers 15 and 16 other than the driving roller 14 are moved so that the photosensitive drums 40Y, 40M, and 40C of yellow, magenta, and cyan are separated from the intermediate transfer belt 10.

The image forming apparatus 20 includes a secondary transferring device 22 as a secondary transfer unit on a side opposite to the image forming units 18Y, 18M, 18C, and 18Bk via the intermediate transfer belt 10. The secondary transferring device 22 is formed with a secondary transfer belt 24 which is an endless belt being stretched between two rollers 23 and being pressed onto the third supporting roller 16 via the intermediate transfer belt 10, thereby transferring an image on the intermediate transfer belt 10 onto a transfer sheet.

Alongside the secondary transferring device 22, a fixing device 25 that fixes the transferred image on the transfer sheet is provided. The fixing device 25 is formed by pressing a pressure roller 27 onto a fixing belt 26 as an endless belt.

The secondary transferring device 22 has a function of conveying the transfer sheet after image transfer to the fixing device 25. As the secondary transferring device 22, a transfer roller or a non-contact charger can be used. In such a case, combined provision of this transfer-sheet conveying function is difficult.

Under the secondary transferring device 22 and the fixing device 25, a transfer-sheet reversing device 28 that reverses the transfer sheet to record images on both sides of the transfer sheet is arranged in parallel to the image forming units 18Y, 18M, 18C, and 18Bk.

When the image forming apparatus 20 is used for copying, a document is set on a document table 30 of the ADF 400 or is set on a contact glass 32 of the scanner 300 by opening the ADF 400 and is then pressed by closing the ADF 400.

Then, when a start switch (not shown) is pressed, the document is conveyed to be moved onto the contact glass 32 when a document is set on the ADF 400, whilst the scanner 300 is immediately driven to cause a first running member 33 and a second running member 34 to run when a document is set on the contact glass 32. Then, in the first running member 33, light is emitted from a light source and reflected light from the document surface is further reflected toward the second running member 34 by a mirror of the second running member 34 to be input to a reading sensor 36 through an image forming lens 35 for reading the document.

Also, when the start switch (not shown) is pressed, a driving motor (not shown) drives one of the supporting rollers 14, 15, and 16 for rotation to drive and rotate the other two supporting rollers, thereby moving the intermediate transfer belt 10. At the same time, the photosensitive drums 40Y, 40M, 40C, and 40Bk are rotated by the relevant image forming units 18 to form single-color images of yellow, magenta, cyan, and black on the photosensitive drums 40Y, 40M, 40C, and 40Bk. Then, with primary transfer biases applied by the primary transfer rollers 62Y, 62M, 62C, and 62Bk together with the conveyance of the intermediate transfer belt 10, these single-color images are sequentially transferred for primary transfer to form a combined color image on the intermediate transfer belt 10.

On the other hand, when the start switch (not shown) is pressed, one of feeding rollers 42 of the feeding table 200 is selectively rotated to unreel the transfer sheets from one of feeding cassettes 44 in plural stages provided to a paper bank 43. These sheets are separated from each other one by one at separation rollers 45 to be put in a feeding path 46, and each sheet is conveyed by conveyance rollers 47 for guidance to a feeding path 48 in the copier body 100 and is then stopped as being struck upon resist rollers 49.

Alternatively, transfer sheets on a bypass tray 51 are unreeled by rotating a feeding roller 50, and are separated from each other one by one by separation rollers 52 to be in a bypass path 53 and are then stopped as being struck upon the resist rollers 49.

Then, in synchronization in timing with the combined color image on the intermediate transfer belt 10, the resist rollers 49 are rotated to send the transfer sheet between the intermediate transfer belt 10 and the secondary transferring device 22. Transfer is then performed by the secondary transferring device 22 to record a color image on the transfer sheet.

The transfer sheet after image transfer is conveyed by the secondary transferring device 22 to be sent to the fixing device 25. After the transferred image is fixed at the fixing device 25 by heat and pressure, switching is made by a switching nail 55 to deliver the transfer sheet by delivering rollers 56, and the transfer sheet is then stacked on a delivery tray 57. Alternatively, switching is made by the switching nail 55 to put the transfer sheet in the transfer-sheet reversing device 28, where the transfer sheet is reversed to be guided again to a transfer position and, after an image is recorded also on the back side, the transfer sheet is delivered by the delivering rollers 56 for delivery on the delivery tray 57.

On the other hand, as for the intermediate transfer belt 10 after image transfer, residual toner left on the intermediate transfer belt 10 after image transfer is removed by the intermediate-transfer-belt cleaning device 17 for preparation for image formation again by the image forming apparatus 20.

The resist rollers 49 are often used as generally being grounded; however, it can be applied with a bias for removal of paper powder of the transfer sheet. A bias is applied by using, for example, a conductive rubber roller. The conductive rubber roller is a conductive nitrile butadiene rubber (NBR) having a diameter $\phi$ of 18 millimeters and a surface thickness of 1 millimeter. The electrical resistance is assumed to be 10E9 ohm centimeters as a volume resistivity of the rubber material, and the applied bias is assumed to be on the order of −800 volts on a side (surface side) on which toner is transferred and on the order of +200 volts on the reverse side.

In general, in the intermediate transfer scheme, paper powder is difficult to move to the photosensitive drum 40. Therefore, it is less necessary to consider paper powder transfer, and therefore, grounding is possible. Also, although a direct-current (DC) bias is applied as an applied voltage, an alternate-current (AC) voltage may be applied having a DC offset component for more uniformly charging the transfer sheet.

The surface of the sheet after passing through the resist rollers 49 applied with the bias in the manner as explained above has been charged slightly to a minus side. Therefore, at the time of transferring onto the transfer sheet from the intermediate transfer belt 10, transfer conditions are changed compared with the case where no voltage is applied to the resist rollers 49. Accordingly, a change of the transfer conditions is required in some cases.

Meanwhile, in the image forming apparatus 20 as in the embodiment, the toner image on the intermediate transfer belt passes through the primary transfer nip repeatedly. Therefore, there may be a case where the toner is reversely charged at this primary transfer nip, which causes reverse transfer of the toner on the intermediate transfer belt to a photosensitive member side. In particular, the Y-color toner, which is transferred onto the intermediate transfer belt first, passes three times through the primary transfer nips of M color, C color, and Bk color, and therefore the amount of toner of reverse transfer is large. For this reason, irregularity noticeably appears on the Y-color image. To get around this problem, in the conventional technology, the amount of Y-color adhered toner is larger than the amount of other-color attachment so that a predetermined amount of attachment is kept even with reverse transfer. In this case, however, the Y-color toner is consumed more than other toners, and a Y-color toner bottle has to be frequently replaced. According to the embodiment, primary transfer biases Vm, Vc, and Vb applied to the other-color primary transfer rollers are set lower than a primary transfer bias Vy applied to the Y-color primary transfer roller positioned most upstream in an intermediate-transfer-belt moving direction to prevent reverse transfer. A specific configuration is explained below.

Figure 2:
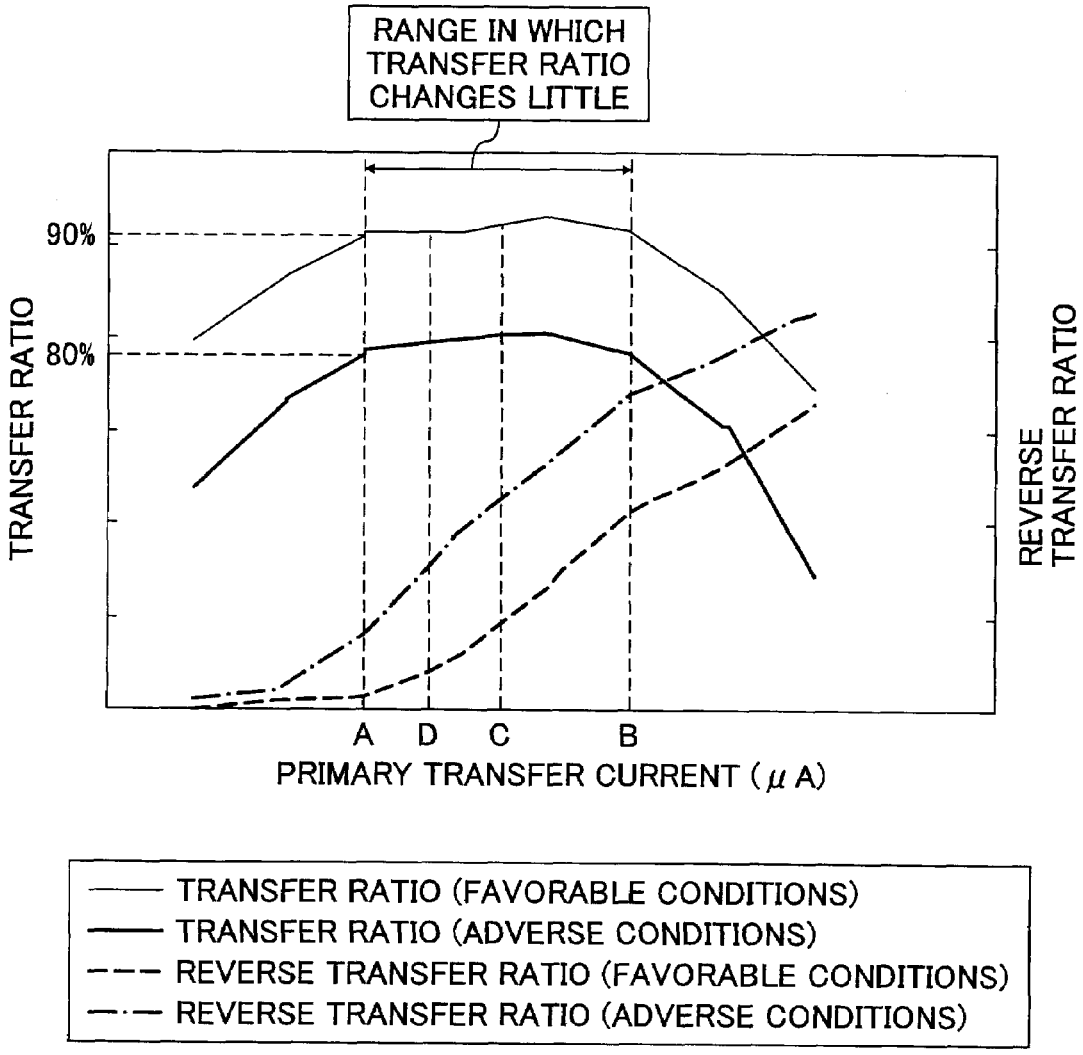
FIG. 2 is a graph of a relation among a transfer ratio, a reverse transfer ratio, and a primary transfer bias (primary transfer current)

FIG. 2 is a graph of a relation among a transfer ratio, a reverse transfer ratio, and a primary transfer bias (primary transfer current). It can be seen from FIG. 2 that, when the primary transfer current is increased, the reverse transfer ratio is also increased, but the transfer ratio fluctuates near a transfer ratio peak in a range indicated by a double-headed arrow in FIG. 2. The relation between the transfer ratio and the transfer current is significantly fluctuated due to fluctuations in environment as shown in FIG. 2. The relation between the transfer ratio under favorable conditions and the primary transfer current and the relation between the transfer ratio under adverse conditions and the primary transfer current are different from each other only in that the transfer ratio is decreased in the latter relation. However, depending on environmental conditions, the relation between the transfer ratio and the primary transfer current may be shifted to the right side in FIG. 2 or may be shifted to the left side in FIG. 2.

Since the Y-color primary transfer nip is positioned upstream the other-color primary transfer nips in the intermediate-transfer-belt moving direction, other toners are not attached on the intermediate transfer belt passing through the Y-color primary transfer nip. Therefore, at the Y-color primary transfer nip, the reverse transfer ratio does not have to be considered. Thus, at the Y-color transfer nip, a primary transfer current value C is set, for example, at a center of a peak range of the transfer ratio, so that the primary transfer current remains in the peak range of the transfer ratio (the range indicated by the double-headed arrow in FIG. 2) even if the relation between the transfer ratio and the primary transfer current may be shifted to the right side in FIG. 2 or may be shifted to the left side in FIG. 2 depending on environmental conditions.

On the other hand, through the other-color transfer nip downstream the Y-color primary transfer nip, the intermediate transfer belt with at least the Y-color toner being attached passes, and reverse transfer occurs. For this reason, the primary transfer currents for M, C, and Bk colors to be applied to the primary transfer rollers 62M, 62C and 62Bk have to be set at a value in consideration of the reverse transfer ratio and the transfer ratio. Therefore, if the primary transfer current is set at a minimum value A of the peak range of the transfer ratio (the range indicated by the double-headed arrow in FIG. 2), the reverse transfer ratio can be suppressed. Also, a decrease in transfer ratio can be suppressed. However, if the primary transfer current is set at the minimum value A of the peak range of the transfer ratio (the range indicated by the double-headed arrow in FIG. 2) and the relation between the transfer ratio and the primary transfer current is shifted to the right side in FIG. 2, the primary transfer current may go out of the peak range of the transfer ratio (the range indicated by the double-headed arrow in FIG. 2). Consequently, the transfer ratio significantly decreases. To get around this problem, the primary transfer current has to be set larger than the minimum value A in the peak range of the transfer ratio (the range indicated by the double-headed arrow in FIG. 2). Thus, the primary transfer currents to be applied to the M-, C-, and Bk-color primary transfer rollers 62M, 62C, and 62Bk are set at a minimum value D that does not go out of the peak range of the transfer ratio (the range indicated by the double-headed arrow in FIG. 2) even if the relation between the transfer ratio and the primary transfer current is shifted to the right side in FIG. 2. With this, the reverse transfer ratio can be suppressed. Also, even if environmental fluctuations occur, a significant decrease in the transfer ratio can be suppressed.

Also, when a so-called toner recycling system is provided in which residual transfer toner on the photosensitive member is collected to be returned for development and reuse, with reverse transfer being suppressed, mixing toner of another color can be suppressed.

Furthermore, the primary transfer biases may be set higher for the primary transfer roller nearer to the upstream in a belt moving direction. In the following, the case where the color order is Y→M→C→Bk is explained.

Even if each of the primary transfer biases of M, C, and Bk colors is set at D explained above, the primary transfer bias may be out of the peak range of the transfer ratio depending on environments or others. If the primary transfer bias is out of the peak range of the transfer ratio, transferability of M, C, and Bk is decreased across the board. Then, the overall primary transfer ratios including reverse transfer are such that M<C<Bk, indicating deterioration as being nearer the upstream in the belt moving direction. The reason for this is as follows. For the M color, the amount of adhered toner on the intermediate transfer belt is decreased due to reverse transfer of the C and Bk colors. For the C color, the amount of adhered toner is decreased due to reverse transfer of only the Bk color and, for the Bk color, the amount of attachment on the intermediate transfer belt is not decreased due to reverse transfer. Therefore, even if the Bk color is out of the peak range of the transfer ratio to slightly decrease transferability, the overall primary transfer ratio is not significantly decreased. On the other hand, for the M color, when the primary transfer bias is out of the peak range of the transfer ratio to decrease transferability to decrease the amount of toner to be attached onto the intermediate transfer belt, the decreased amount of toner on the intermediate transfer belt is deprived further of the toner on the intermediate transfer belt due to reverse transfer at the nips of the C and B colors. Consequently, the overall primary transferability significantly decreases. That is why the overall primary transfer ratio including reverse transfer is deteriorated in the order of Bk, C, and then M if the primary transfer bias is out of the peak range of the transfer ratio to decrease transferability of M, C, and Bk across the board. Therefore, the primary transfer biases of the intermediate transfer belt are set as Y>M>C>Bk so that the primary transfer bias is difficult to be out of the peak range of the transfer ratio in the order of the Bk, C, and M colors. With this, even if the primary transfer bias of the Bk color is out of the peak range of the transfer ratio, the primary transfer biases of the M and C colors can be within the peak range of the transfer ratio. Thus, for the M and C colors, the overall primary transfer ratio is not decreased. Also, even if the primary transfer bias of the Bk color is out of the peak range of the transfer ratio and slightly decreases transferability, a decrease in the overall primary transfer ratio is small compared with the case where transferability of the C and M colors decrease. Thus, influence on image quality can be suppressed. Therefore, for the Bk color, the primary transfer bias value (minimum value D) is set in consideration of reverse transfer. Furthermore, even if the primary transfer bias of the C color is out of the peak range of the transfer ratio to decrease transferability to decrease the amount of adhered toner, the C color is deprived of its toner only due to reverse transfer of the Bk color. In addition, since the transfer bias of the Bk color is suppressed low, the amount of toner of reverse transfer is suppressed. Therefore, compared with the case where transferability of the M color is decreased, a decrease in the overall transferability can be suppressed. Thus, for the C color, its primary transfer bias is set larger than that of the Bk color and smaller than that of the M color in consideration of both of reverse transfer and a decrease in transferability due to environmental fluctuations. Furthermore, since the overall transferability is significantly decreased when the primary transfer bias of the M color is out of the peak range of the transfer ratio to decrease transferability to decrease the amount of adhered toner, the primary transfer bias of the M color is set higher than those of the C and Bk colors in consideration of a decrease in transferability due to environmental fluctuations. With this, even with the occurrence of environmental fluctuations and others, a decrease in the overall transfer ratio can be suppressed compared with the case where the primary transfer biases of C, M, and Bk are uniformly set at the minimum value D. Thus, image quality can be reliably maintained.

Also, it is assumed in the embodiment that the toner to be transferred onto the intermediate transfer belt 10 first is the toner of the Y color. This is because the Y color tends to be more inconspicuous than other colors even with image failures, such as irregularity and white streaks. Since the toner to be transferred onto to the intermediate transfer belt first passes through the largest number of primary transfer nips, the reverse transfer ratio is the worst and irregularity and white streaks tend to occur most often. If such irregularity and white streaks occur, image failures occur, such as color unevenness. For this reason, with the Y-color toner, which tends to be more inconspicuous than other colors even with irregularity and white streaks, being transferred onto the intermediate transfer belt 10 first, image failures, such as color unevenness, can be made difficult to be checked through visual inspection even with the occurrence of irregularity and white streaks to some degree.

Further, it is assumed in the embodiment that the toner to be lastly transferred onto the intermediate transfer belt 10 is the toner of the Bk color. A portion of the intermediate transfer belt 10 on which the toner is present has a weak primary transfer electric field due to an influence of resistance of the toner compared with a portion on which no toner is present. Therefore, when a toner is transferred onto the portion on the intermediate transfer belt where a toner is present, transferability at that portion is decreased. It is often the case for the toners of the M and C colors that a toner is transferred onto the portion on the intermediate transfer belt where a toner is present. For this reason, to achieve sufficient transferability even if primary transfer is performed on a portion where the toner is present, the primary transfer bias cannot be significantly decreased. On the other hand, in general, the toner of the Bk color is not superposed on the toner of another color. Therefore, there is no influence of resistance of the toner on the intermediate transfer belt at the time of primary transfer. Thus, compared with the M and C colors, even if the primary transfer bias is weakened, excellent transferability can be achieved. Therefore, the primary transfer bias of the Bk color can be set smaller than the primary transfer biases of the C and M colors. Therefore, with the toner of the Bk color being taken as the toner to be lastly transferred onto the intermediate transfer belt 10, reverse transfer of other colors can be suppressed to the minimum.

Also, when the color toner image on the intermediate transfer belt is transferred onto the transfer sheet for secondary transfer, at a portion where toners of a plurality of colors are superposed, the toner color of a lower layer (on an intermediate transfer belt side) is left on the intermediate transfer belt 10 as a residual transfer toner. As a result, irregularity or color unevenness may occur in the color image on the transfer sheet. Therefore, the colors are preferably transferred in the order in which irregularity and color unevenness are more inconspicuous in the color image on the transfer sheet even if the lower layer of the toner image with a plurality of colors superposed thereon is left on the intermediate transfer belt as a residual transfer toner.

Table 1 contains the results of an examination of irregularity levels of a red image, a green image, and a blue image formed on a transfer sheet with different orders of transfer onto the intermediate transfer belt 10 in the image forming apparatus 20. The red image is formed by superposing the toner of the Y color and the toner of the M color, the green image is formed by superposing the toner of the Y color and the toner of the C color, and the blue image is formed by superposing the toner of the M color and the toner of the C color. In the evaluations of the irregularity levels, a circle indicates that irregularity is allowable, whilst a cross indicates that irregularity is not allowable.

TABLE 1

| | Irregularity level | | |
|---|---|---|---|
| Image forming order | Red | Green | Blue |
| YMCK | ○ | ○ | ○ |
| YCMK | ○ | ○ | X |
| MCYK | X | X | ○ |
| CMYK | X | X | X |

It can be seen from Table 1 that, as for the red image formed by superposing the toner of the Y color and the toner of the M color, the toner of the Y color is transferred onto the intermediate transfer belt 10 earlier than the toner of the M color, which makes the irregularity level allowable. The reason for this is as follows. When the toner of the Y color is transferred onto the intermediate transfer belt 10 earlier, the toner of the Y color is left on the intermediate transfer belt 10 as a residual transfer toner. As a result, the background color, that is, magenta, appears at a portion of the red image on the transfer sheet from which the toner of the Y color is lost. Since magenta is the same series as that of red, irregularity of the red image tends to be inconspicuous. That may be why the level can be suppressed to an irregularity-allowable level.

Also, it can be seen from Table 1 that, as for the green image formed by superposing the toner of the Y color and the toner of the C color, the toner of the Y color is transferred onto the intermediate transfer belt 10 earlier than the toner of the C color, which makes the irregularity level allowable. The reason for this is as follows. When the toner of the Y color is transferred onto the intermediate transfer belt 10 earlier, the background color of the green image on the transfer sheet is cyan. With cyan as the background, even if yellow is lost at the secondary transfer unit, irregularity of the green image tends to be inconspicuous. That may be why the level can be suppressed to an irregularity-allowable level.

Furthermore, it can be seen from Table 1 that, as for the blue image formed by superposing the toner of the M color and the toner of the C color, the toner of the M color is transferred onto the intermediate transfer belt 10 earlier than the toner of the C color, which makes the irregularity level allowable. The reason for this is as follows. When the toner of the M color is transferred onto the intermediate transfer belt 10 earlier, the background color of the blue image on the transfer sheet is cyan. With cyan as the background, even if magenta is lost at the secondary transfer unit, irregularity of the blue image tends to be inconspicuous. That may be why the level can be suppressed to an irregularity-allowable level.

Therefore, with the order of transfer onto the intermediate transfer belt as Y→M→C→Bk, even if the toner color of the lower layer (on the intermediate transfer belt side) is left on the intermediate transfer belt 10 as a residual transfer toner at the time of secondary transfer, irregularity of the color image on the transfer sheet can be suppressed.

In the embodiment, to keep excellent primary transferability in successive printing even if the primary transfer biases to be applied to the primary transfer rollers of the C, M, and Bk colors are decreased, the intermediate transfer belt 10 is such that, after five seconds since a voltage of 500 volts is applied, the surface potential of the voltage-applied position becomes equal to or lower than 250 volts. That is, the intermediate transfer belt 10 is such that a surface potential attenuation ratio, which is a ratio of a charge on the surface of the intermediate transfer belt left after five seconds, becomes equal to or smaller than half.

The reason for using such an intermediate transfer belt is as follows. When the intermediate transfer belt 10 passes through a primary transfer nip, an influence of the primary transfer electric field causes a minus charge to be moved onto the surface of the intermediate transfer belt and a plus charge to be moved onto the back surface of the intermediate transfer belt 10. When the intermediate transfer belt 10 has passed through the primary transfer nip to no longer receive the influence of the primary transfer electric field, the minus charge on the surface of the intermediate transfer belt is moved to the back surface side of the intermediate transfer belt, whilst the plus charge on the back surface of the intermediate transfer belt is moved onto the surface of the intermediate transfer belt. Then, with the charges being cancelled each other, the potential of the intermediate transfer belt becomes attenuated. However, in the case of an intermediate transfer belt that is difficult to be attenuated with its potential attenuation ratio being equal to or greater than half, even if the intermediate transfer belt is rotated once, the minus potential is still left on the surface of the intermediate transfer belt. As a result, when successive printing is performed, the potential of the intermediate transfer belt is gradually increased and, with the influence of the surface potential of the intermediate transfer belt, the primary transfer electric field acted on the transfer nip becomes weakened. As a result, as for the colors of C, M, and Bk each in which the transfer electric field is weakened by decreasing the primary transfer bias, the primary transfer electric field is further weakened. Therefore, when successive printing is performed, transferability of the M, C, and Bk colors is decreased when printing is performed for a predetermined number of sheets.

However, in the embodiment, the intermediate transfer belt 10 is used with its surface potential attenuation ratio being equal to or smaller than half is used. Therefore, before the intermediate transfer belt passes through the next primary transfer nip, the surface potential of the intermediate transfer belt is excellently attenuated. Even when successive printing is performed, the primary transfer electric field is not weakened by the surface potential of the intermediate transfer belt. For this reason, even if the primary transfer biases to be applied to the primary transfer rollers of the C, M, and Bk colors are decreased when successive printing is performed, excellent transferability can be kept.

Figure 3:
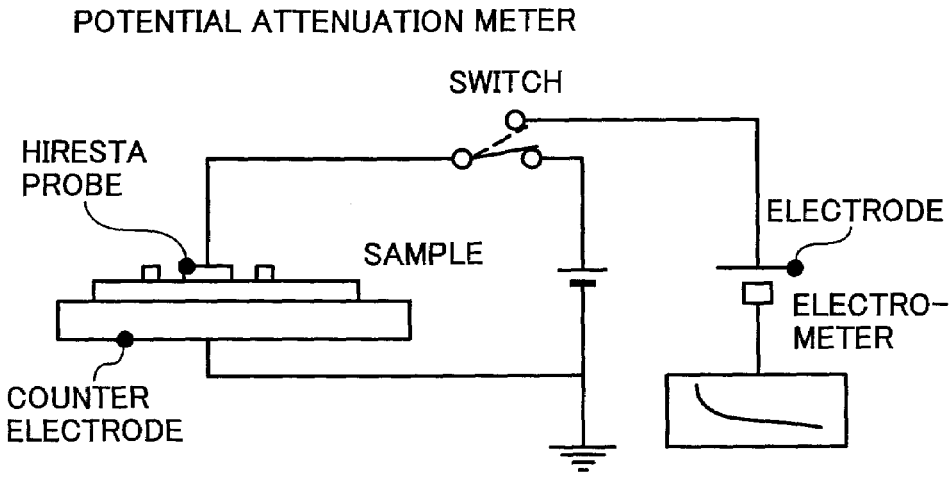
FIG. 3 is a schematic diagram of an attenuation-characteristic measuring device used to measure a surface-potential attenuation ratio of an intermediate transfer belt shown in FIG. 1.

To measure the surface potential attenuation ratio of the intermediate transfer belt 10, a potential attenuation meter (attenuation-characteristic measuring device) shown in FIG. 3 was used. The potential attenuation meter includes a probe, a counter electrode, and an electrometer. The probe is pressed onto one side of the intermediate transfer belt, and the grounded counter electrode is contacted with the opposite side. As the probe, a URS probe: MCP-HTP14 (Mitsubishi Chemical Corporation) for Hiresta-UP: MCP-HT450 high resistivity meter (Mitsubishi Chemical Corporation) is used. A voltage of 500 volts can be applied through a switch shown in FIG. 3 at a predetermined timing. After the voltage is applied, the switch is switched to measure the potential on the surface of the intermediate transfer belt in a non-contact manner. COR-A-TROL (610C) from Trek was used as a high-voltage power supply, whilst MODEL 344 from Trek was used as a surface potentiometer.

With the surface potential attenuation ratio of the intermediate transfer belt 10 being equal to or smaller than half, transfer unevenness can also be suppressed. The causes for the occurrence of transfer unevenness can be broadly divided into the following two.

One is that potential unevenness that is influenced by a latent image on the photosensitive drum 40 at the time of primary transfer and copies a potential difference may occur on the surface of the intermediate transfer belt 10. If the surface of the intermediate transfer belt with the occurrence of such potential unevenness enters the next primary transfer nip for primary transfer, transfer unevenness occurs correspondingly to the potential unevenness explained above.

A potential difference on the surface of the intermediate transfer belt 10 occurring at the time of primary transfer occurs as follows. When a latent image is formed on the photosensitive drum 40, a difference in surface potential occurs between an image portion where the latent image is formed and a non-image portion (also called a background portion) where no latent image is formed. Even when this latent image is developed, the difference in potential is present between the image portion and the non-image portion on the surface of the photosensitive drum 40. When such a photosensitive drum 40 faces the primary transfer member, such as a primary transfer roller, at the primary transfer nip across the intermediate transfer belt, different potentials with respect to the primary transfer roller are present between the image portion and the non-image portion. The primary transfer electric field is strong in a portion having a larger potential difference, whilst the primary transfer electric field is weak in a portion having a smaller potential difference. In a portion where the primary transfer electric field is strong, the amount of a flowing current is increased. Therefore, compared with a portion where the primary transfer electric field is weak, the surface potential of the intermediate transfer belt 10 is high. Such potential unevenness is kept until the next primary transfer, and a difference in primary transfer efficiency occurs, which causes transfer unevenness.

Moreover, there may be the case where potential unevenness occurring on the surface of the intermediate transfer belt passing through the transfer nip for primary transfer of the last color is left to the primary transfer nip for the next image after passing through the secondary transfer nip to cause transfer unevenness at the time of transferring the next image for primary transfer. Potential unevenness occurring on the surface of the intermediate transfer belt after passing through the transfer nip for primary transfer of the last color may occur not only due to one of a plurality of times of primary transfer from the first color to the last color, but also due to accumulation of such plural times of primary transfer.

Next, the examination results by the inventor about the relation between the surface potential attenuation ratio of the intermediate transfer belt 10 and transfer unevenness are explained.

Figure 4:
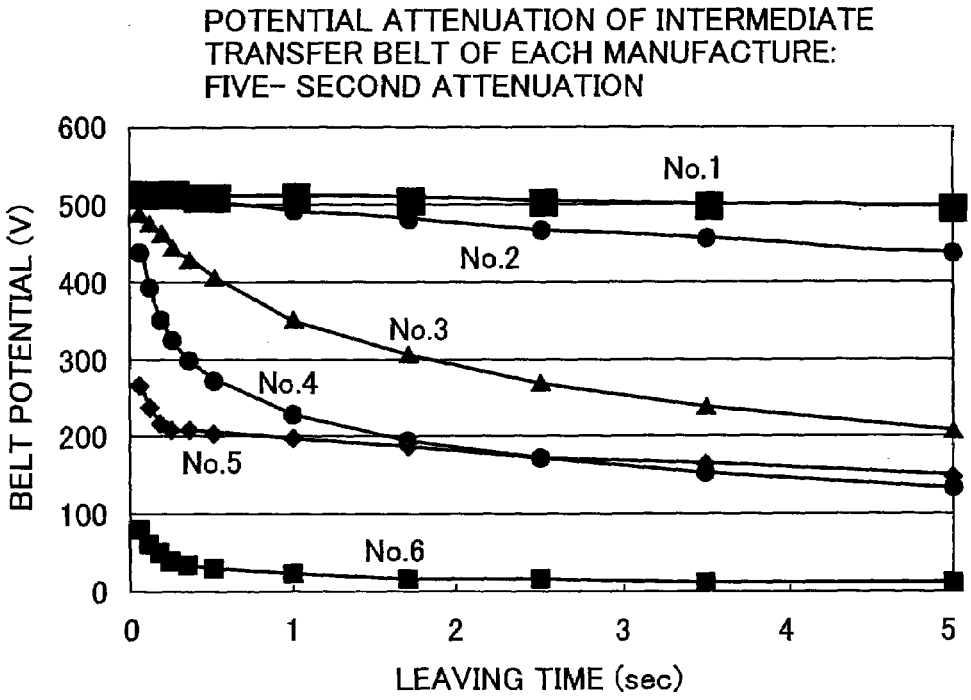
FIG. 4 is a graph of residual potentials of six intermediate transfer belts with respect to elapsed time after a voltage is applied thereto.

Table 2 contains the results obtained by the image forming apparatus 20 and six intermediate transfer belts No. 1 to No. 6 with different surface potential attenuation ratios to perform image formation and evaluating the state of transfer unevenness on the finally-obtained image. Various conditions for this evaluation are described below. FIG. 4 is a graph of residual potentials with respect to elapsed time after a voltage of 500 volts is applied to the six intermediate transfer belts No. 1 to No. 6. The six intermediate transfer belts No. 1 to No. 6 are single-layer seamless belts made of polyimide resin. These six belts with different potential attenuation characteristics were obtained by adjusting a conducting agent.

Linear velocity of the intermediate transfer belt: 282 mm/sec

Perimeter of the intermediate transfer belt: 1178 millimeters

A space between an adjacent pair of the photosensitive drums 40 is 150 millimeters, where the space between the photosensitive drums 40 is a space between adjacent positions of primary transfer nips formed for each color by the photosensitive drum 40 and the intermediate transfer belt 10 facing each other. Each space between the photosensitive drums 40 is equal. That is, a distance between Y and C, a distance between C and M, and a distance between M and Bk are equal to one another. In the evaluations of transfer unevenness, three ranks were used: a circle indicates "no problem", a triangle indicates "allowable limit", and a cross indicates "not allowable".

TABLE 2

| | Five-second potential value (Volt) | Transfer unevenness |
|---|---|---|
| Belt No. 1 | 481 | X |
| Belt No. 2 | 436 | X |
| Belt No. 3 | 207 | Δ |
| Belt No. 4 | 134 | ○ |

TABLE 2-continued

| | Five-second potential value (Volt) | Transfer unevenness |
|---|---|---|
| Belt No. 5 | 151 | ○ |
| Belt No. 6 | 11 | ○ |

X: Not allowable
Δ: Allowable limit
○: No problem

According to the results shown in Table 2, when the intermediate transfer belt 10 No. 3 in which a five-second potential value is 207 volts after 500 volts is applied is used, transfer unevenness was as indicated by a triangle, meaning an allowable limit. When the intermediate transfer belts No. 4 to No. 6 with their surface potential being attenuated more than No. 3 is used, transfer unevenness was as indicated by a circle, meaning no problem. On the other hand, when the intermediate transfer belt 10 No. 2 and No. 1 merely attenuated to have a five-second potential value of 436 volts and 481 volts, respectively, are used, transfer unevenness was as indicated by a cross, meaning not allowable. From these, it can be found that transfer unevenness can be within an allowable range with the use of the intermediate transfer belt 10 with its surface potential attenuation ratio being equal to or smaller than half after five seconds since a primary transfer bias Vo is applied.

From the results mentioned above, by using the intermediate transfer belt 10 with its potential five-second value being equal to or smaller than half since the primary transfer bias Vo is applied to the intermediate transfer belt 10, the charges on the surface of the intermediate transfer belt 10 occurring at the time of primary transfer or secondary transfer are attenuated to such a degree of not hindering the next primary transfer.

With this, even if potential unevenness that copies a potential difference of the latent image on the photosensitive drum 40 at the previous primary transfer occurs on the surface of the intermediate transfer belt 10, when the surface of the intermediate transfer belt 10 on which potential unevenness enters the next primary transfer nip for primary transfer, the potential unevenness is not left to a degree of causing transfer unevenness. Also, even if the surface of the intermediate transfer belt passes through the secondary transfer unit to be provided with charges having the same polarity as that of the toner, the potential is not left to a degree of causing transfer unevenness at the time of next primary transfer.

Also, the intermediate belt is set to have a volume resistivity equal to or greater than $1\times10^{8}$ ohm centimeters and equal to or smaller than $1\times10^{11}$ ohm centimeters. If volume resistivity of the intermediate transfer belt is as low as smaller than $1\times10^{8}$ ohm centimeters, for example, when a primary transfer bias is applied, the surface potential of the intermediate transfer belt upstream of the primary transfer nip portion is increased. With this, at the upstream of the primary transfer nip portion, toner on the photosensitive member flies by the action of the primary transfer electric field, causing transfer dust, which is an abnormal image in which a toner image flies to be distributed to the non-image portion. Moreover, an influence of a resistance of the toner layer is increased, and thereby, solid-portion transferability decreases.

On the other hand, if the volume resistivity exceeds $1\times10^{11}$ ohm centimeters, the primary transfer current is difficult to flow, which deteriorates solid-portion transferability. Also, the movement of charges in the intermediate transfer belt is degraded, resulting in a low potential attenuation characteristic. As a result, the surface potential attenuation ratio in the intermediate transfer belt is half and more, causing a decrease in transferability at the time of successive printing and a residual image trace. The residual image trace herein is such that charges left due to an influence of the previously-formed toner image disturb primary transferability of a subsequently-formed toner image, resulting in a trace of the previous toner image.

Table 3 contains the results obtained by the image forming apparatus 20 and seven different intermediate transfer belts No. 7 to No. 13 to perform image formation and evaluating transfer dust, solid-portion transferability, and a residual image trace. The seven intermediate transfer belts are single-layer seamless belts made of polyimide resin. These belts with different volume resistivities were obtained by adjusting a conducting agent.

In the evaluation of transfer dust, a dust level around characters, lines, and solid images was evaluated, and three ranks were used: a circle indicates "no problem", a triangle indicates "allowable limit", and a cross indicates "not allowable".

In the evaluation of solid-portion transferability, density evenness of a solid image formed on a transfer sheet was evaluated, and three ranks were used: a circle indicates "no problem", a triangle indicates "allowable limit", and a cross indicates "not allowable".

In the evaluations of the residual image trace, a residual-image level of a test pattern formed on the transfer sheet was evaluated. Since residual images have a characteristic in which the previous image history appears on the next image, several tens of sheets were caused to pass for successive patterns to be evaluated. In the evaluation of the residual-image level, three ranks were used: a circle indicates "no problem", a triangle indicates "allowable limit", and a cross indicates "not allowable".

TABLE 3

| | Belt No. 7 | Belt No. 8 | Belt No. 9 | Belt No. 10 | Belt No. 11 | Belt No. 12 | Belt No. 13 |
|---|---|---|---|---|---|---|---|
| Volume resistivity of intermediate transfer member (ohm centimeters) | $2\times10^{11}$ | $1\times10^{12}$ | $5\times10^{7}$ | $1\times10^{7}$ | $1\times10^{8}$ | $1\times10^{9}$ | $1\times10^{11}$ |
| Dust | ○ | ○ | Δ | X | ○ | ○ | ○ |
| Solid-portion transferability | ○ | Δ | Δ | X | ○ | ○ | ○ |
| Residual image trace | Δ | X | ○ | ○ | ○ | ○ | ○ |

According to the results shown in Table 3, a residual image trace was seen on the intermediate transfer belts No. 7 and No. 8 with the volume resistivity exceeding $1\times10^{11}$ ohm centimeters. As for the intermediate transfer belt No. 8, solid-portion transferability was decreased. Also, as for the intermediate transfer belts No. 9 and No. 10 with the volume resistivity lower than $1\times10^{8}$ ohm centimeters, transfer dust and solid-portion transferability were decreased. On the other hand, as for the intermediate transfer belts No. 11 to No. 13 with the volume resistivity equal to or greater than $1\times10^{8}$ ohm centimeters and equal to or smaller than $1\times10^{11}$ ohm centimeters, transfer dust, solid-portion transferability, and the residual image trace all had no problem, and an excellent image can be obtained. Accordingly, with the volume resistivity being set equal to or greater than $1\times10^{8}$ ohm centimeters and equal to or smaller than $1\times10^{11}$ ohm, it can be found that an excellent image can be obtained without transfer dust, solid-portion transferability, or a residual image trace.

Also, the intermediate transfer belt 10 is preferably a single-layer belt. The reason for this is as follows. If the intermediate transfer belt 10 has two or more layers, charges are accumulated on a boundary surface between layers, which deteriorates the potential attenuation of the intermediate transfer belt 10. As a result, the intermediate transfer belt 10 reaches the next primary transfer nip in a state where the intermediate transfer belt 10 is charged to a predetermined potential. Consequently, as with the case mentioned above, the primary transfer electric field is weakened, and therefore, a predetermined transferability cannot be achieved. If the intermediate transfer belt is a single-layer belt, on the other hand, there is no such case where charges are accumulated on a boundary surface between layers, and a high potential attenuation characteristic can be achieved. With the potential of the intermediate transfer belt 10 being sufficiently attenuated, the intermediate transfer belt 10 can be caused to reach the next primary transfer nip.

Examples of the material of the intermediate transfer belt include resin materials, such as polyvinylidene fluoride (PVDF), polyimide (PI), polycarbonate (PC), and ethylene-tetrafluoroethylene copolymer (ETFE), and resin materials having any of these materials as main materials.

To control electric resistance, an electron-conductive conducting agent or an ion-conductive conducting agent is added to these materials. Examples of the electron-conductive conducting agent include carbon black, graphite, aluminum, nickel metal, or metal oxides, such as tin oxide, zinc oxide, titanic oxide, antimony oxide, indium oxide, and potassium titanate. Also, examples of the ion-conductive conducting agent include sulfonate, ammonia salt, and others, or various surface active agents, such as cationic, anionic and nonionic surface active agents. Also, conductive polymer may be blended. By mixing one or two or more of these conducting agents, conductive polymers, and surface active agents, the resistance to be obtained can be stably achieved.

A preferable example of the intermediate transfer belt 10 is a seamless belt made of polyimide resin with carbon black dispersion. This seamless belt made of polyimide resin with carbon black dispersion can be obtained as follows.

Carbon black is dispersed in a polyamic acid solution, and the dispersion is poured into a metal drum for dry. Then, a film stripped from the drum is spread under a high temperature to form a polyimide film. Furthermore, the film is cut out into an appropriate size to manufacture an endless belt. In a general film forming scheme, a polymer solution with carbon black being dispersed is poured into a cylindrical metal mold. The cylindrical metal mold is then rotated and heated at 100 degrees Celsius to 200 degrees Celsius to form a film shape through centrifugal formation. The obtained film is then taken out in a half-hardened state, and is used to coat an iron core for polyimidization reaction at 300 degrees Celsius to 450 degrees Celsius for hardening.

Next, toner is explained.

In the embodiment, a toner is used in which inorganic particulates, which is an additive externally added to the surface of the toner, has a saturated implantation ratio equal to or greater than 40 percent after an implanting process under the following conditions. By using the toner with the saturated implantation ratio X of inorganic particulates equal to or greater than 40 percent, an image forming apparatus excellent in low-temperature fixability can be provided.

Next, an additive implanting process for calculating the saturated additive implantation ratio X is explained. A toner of 10 grams and a carrier of a resin coat ferrite group of 100 grams are put in a polyethylene ointment bottle with an internal volume of 300 milliliters to 500 milliliters, and are mixed by using a turbula mixer for 30 minutes at 100 revolutions per minute. With this, the progress of implantation of the additive of the toner subsides (saturated). As a carrier of a resin coat ferrite group, any of those conventionally known can be used; a ferrite carrier EF963-60B coated with silicone resin (particle diameter of 35 micrometers to 85 micrometers, manufactured by Powdertech K. K.) was used herein. Also, as a turbula mixer, a turbula mixer T2F type (Willy A. Bachofen (WAB)) was used. Then, water of 300 milliliters is put in the ointment bottle, and is lightly stirred with a stirring bar to separate the toner and the carrier in the water. A toner dispersion, which is a supernatant fluid, is then subjected to a filtering process. The toner obtained through filtering is then decompressed and dried in a room-temperature environment to obtain a toner after the additive implanting process.

BET specific surface areas of the toner before the additive implanting process and the toner after the additive implanting process were measured by using an automatic surface area and porosimetry analyzer TriStar 3000 (Shimadzu Corporation). Specifically, a toner of 1 gram was put in a dedicated cell, and a degassing dedicated unit for TriStar, VacuPrep 061 (Shimadzu Corporation) was then used for degassing process in the dedicated cell. The degassing process was performed at least for 20 hours under the condition of reduced pressure at equal to or less than 100 mtorr at room temperature. The BET specific surface area of the dedicated cell for degassing can be obtained automatically by using TriStar 3000. Nitrogen gas was used as absorbing gas.

Figure 5:
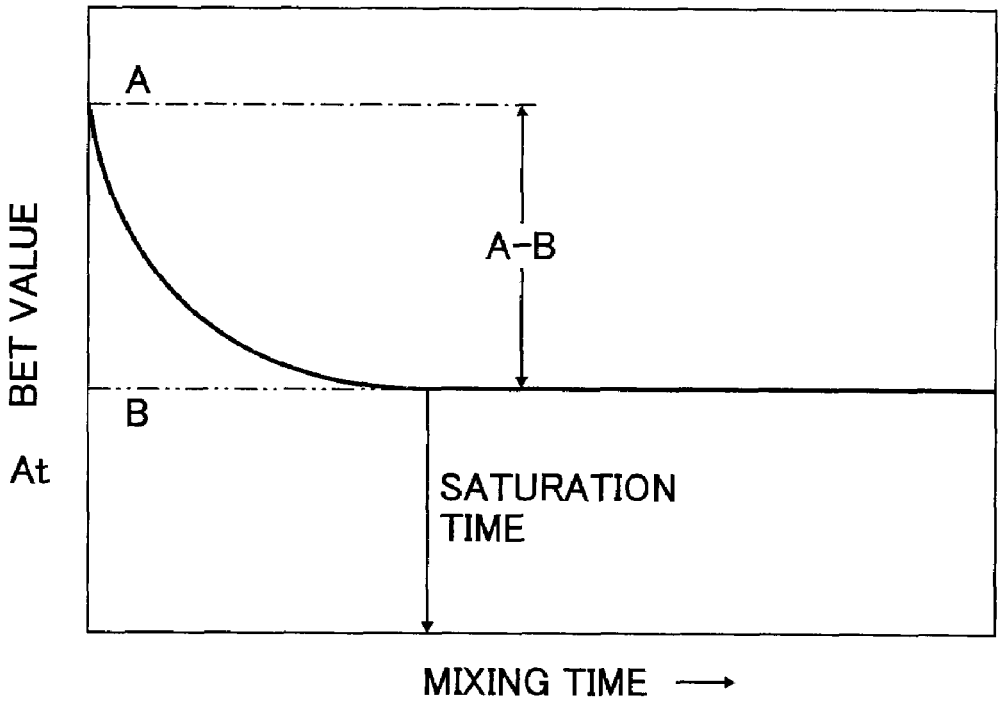
FIG. 5 is a graph of a relation between a toner mixing time and a Brunauer-Emmett-Teller (BET) specific surface area of toner.

As shown in FIG. 5, when the toner is mixed for more than the predetermined time (saturation time) under the conditions explained above (a toner of 10 grams and a carrier of a resin coat ferrite group of 100 grams are put in a polyethylene ointment bottle with an internal volume of 300 milliliters to 500 milliliters, and are mixed by using a turbula mixer at 100 revolutions per minute), the progress of implantation of the additive subsides, and the BET specific surface area indicates an approximately stable value. After mixing (30-minute mixing) the toner until the progress of implantation of the additive of the toner subsides (saturated) under the conditions explained above, the saturated additive implantation ratio X of the inorganic particulates is calculated by using, as in the following equation, a BET specific surface area A ($cm^2/g$) of the toner before the additive implanting process and a BET specific surface area B ($cm^2/g$) of the toner after the additive implanting process.

$$\text{Additive implantation ratio } X(\%)=\{(A-B)/A\}\times100$$

The toner for use in the image forming apparatus according to the embodiment is not particularly restricted as long as it satisfies the conditions explained above, and any toner obtained through a conventionally known manufacturing scheme can be used. Also, as a binding resin and a colorant for use in the toner, any conventionally known can be used.

Examples of the binding resin include polyester resins, styrene resins, acrylic resins, styrene-acrylic resins, polyol resins, and epoxy resins. In particular, as the binding resin for use in view of low-temperature fixability, polyester resins are preferable. A glass transition point (Tg) of the binding resin is 40 degrees Celsius to 75 degrees Celsius, preferably 45 degrees Celsius to 65 degrees Celsius. If Tg is too low, heat-resistance preservability of the toner is deteriorated. Conversely, if Tg is too high, low-temperature fixability is insufficient. Tg can be measured by a differential scanning calorimetry (DSC). Tg was found from a DSC curve obtained under a condition of a temperature-increasing speed of 10 degrees Celsius/min by using DSC-60A (Shimadzu Corporation).

As a colorant, any known dye and pigment can be used. Examples are carbon black, naphthol yellow, Hanza yellow, permanent red, oil red, quinacridon red, phthalocyanine blue, anthraquinone blue, and others, but are not particularly restricted thereto.

Also, the toner may contain a releasing agent together with the binding resin and the colorant. Any known releasing agent can be used. Examples are polyethylene wax, polypropylene wax, and paraffin wax. Also, as required, the toner may contain a charge controlling agent. Any known charge controlling agent can be used. Examples are nigrosine dye and triphenylmethane dye. The amount of charge controlling agent is determined based on the type of the binder resin, the presence or absence of an additive used as required, and a toner manufacturing scheme including a dispersing scheme, and therefore, is not uniquely restricted.

On the other hand, inorganic particulates included as an additive to the toner particles are used for the purpose of improving fluidity characteristics, development characteristics, charging characteristics, and others. Normally, an initial particle diameter of these inorganic particulates for use is preferably 5 nanometers to 2 micrometers. The ratio of use of these inorganic particulates for use is, although depending on the type, usually in a range of 0.01 weight percent to 5 weight percent with respect to the toner particles. Specific examples of inorganic particulates are silica, alumina, titanium oxide, barium titanate, and magnesium titanate. These can be used singly or in combination of two or more.

Also, in the image forming apparatus according to the embodiment, a toner using a polyester resin as a binding resin is suitably used. With the use of a polyester resin as the toner binding resin, an image forming apparatus allowing low-temperature fixing can be provided. The toner using the polyester resin can be obtained through an ester elongation polymerization scheme.

The ester elongation polymerization scheme is a manufacturing scheme of dispersing an organic solvent phase containing polyester prepolymer in a water-based medium phase together with an active-hydrogen containing compound for either one or both of elongation and crosslinking reactions in a water-based medium, removing the organic solvent, and then cleaning and drying to form toner particles. This manufacturing scheme is excellent in granulation, and the particle diameter, particle-size distribution, and shape can be easily controlled. In the following, a manufacturing scheme and materials for use are explained.

Polyester prepolymer is a component that forms a toner binder (binding resin) with a higher molecular weight through either one or both of elongation and crosslinking reactions with an active-hydrogen-containing compound in a water-based medium. An example of polyester prepolymer is a polyester prepolymer having a function group that reacts with an active hydrogen group, such as an isocyanate group. This polyester prepolymer having an isocyanate group is the one for preferable use. This polyester prepolymer is manufactured through reaction of polyester, which is a polycondensation product of polyol (PO) and polycarboxylic acid (PC) and has an active hydrogen group, with polyisocyanate (PIC). Examples of the polycondensation product of polyol (PO) and polycarboxylic acid (PC) having an active hydrogen group include polycondensation products of bisphenol A alkylene oxide adducts and any one of dicarboxilic acids (such as succinic acid, adipic acid, maleic acid, fumaric acid, phthalic acid, and terephtalic acid), and trivalent or more polycaroxilic acids (such as trimellitic acid and pyromellitic acid). Examples of polyisocyanate (PIC) include aliphatic polyisocyanates (such as tetramethylene diisocyanate, hexamethylene diisocyanate, and 2,6-diisocyanatomethyl caproate), alicyclic polyisocyanates (such as isophorone diisocyanate and cyclohexylmethane diisocyanate), aromatic diisocyanates (such as tolylene diisocyanate and diphenylmethane diisocyanate), aromatic-aliphatic diisocyanates (such as $\alpha,\alpha,\alpha',\alpha'$-tetramethylxylylene diisocyanate), isocyanurates, blocked products of the polyisocyanates with, for example, phenol derivatives, oximes, or caprolactams, and mixtures of two or more types of these compounds.

The isocyanate-containing polyester prepolymer generally has one or more, preferably 1.5 to 3 on average, and more preferably 1.8 to 2.5 isocyanate groups per molecule. If the amount of the isocyanate group per molecule is less than 1, the molecular weight of polyester after elongation may be low and the hot offset resistance may deteriorate. Also, as explained above, polyester prepolymer is used by being dissolved in an organic solvent, and the amount of use and formulation is, as a content in a toner matrix, 10 weight percent to 55 weight percent, preferably 10 weight percent to 40 weight percent, and more preferably 15 weight percent to 30 weight percent.

Also, together with the polyester prepolymer, nonreactive polyester can be dissolved into an organic solvent phase for simultaneous use. With simultaneous use of this nonreactive polyester, low-temperature fixability of the toner and luster when used in a full-color apparatus are increased. This is preferable compared with the case where polyester prepolymer is singly used. Examples of nonreactive polyester include a polycondensation product of polyol and polycarboxylic acid, similar to polyester for use in reaction with polyisocyanate, and preferable examples are similar to those mentioned above. When nonreactive polyester is included in the organic solvent phase, the amount of composition is, as a weight ratio of polyester prepolymer and nonreactive polyester, 10/90 to 55/45, preferably 10/90 to 40/60, more preferably 15/85 to 30/70. If the weight ratio of polyester prepolymer is too low, the hot offset resistance may deteriorate, and it may be difficult to achieve both of heat-resistance preservability and low-temperature fixability. Resins other than nonreactive polyester may be used. For example, a conventionally known toner binding resin, such as styrene resin, acrylic resin, epoxy resin, or styrene-acrylic ester copolymer, may be further mixed.

As an active hydrogen compound, amines are preferably used. With the reaction with an isocyanate group of the polyester prepolymer, urea-modified polyester resin can be obtained. Examples of amines include diamine, trivalent or more polyamines, amino alcohol, amino mercaptan, amino acid, and these amines with a blocked amino group. Preferably, 4,4'-diaminodiphenylmethane, isoholondiamine, hexamethylenediamine, ethanol amine, aminoethyl mercaptan, amino propionic acid, and ketimine compounds with these amino groups blocked with ketones, such as methyl ethyl ketone.

A colorant or a colorant masterbatch is most preferably dissolved or dispersed in advance in an organic solvent phase together with polyester prepolymer and nonreactive polyester. Also, as required, a releasing agent or a charge controlling agent may be dissolved or dispersed in an organic solvent phase.

A water-based medium forming the water-based medium phase may be water only, or an organic solvent may also be used in combination. In particular, to decrease viscosity when resin components contained in the organic solvent phase are dispersed in the water-based medium, an organic solvent is preferably used, which can dissolve the resin components. Also, the organic solvent is easy to be evaporated if it is volatile with its boiling point being lower than 100 degree Celsius. For example, toulene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These can be used singly or in combination of two or more.

Also, in the water-based medium, resin particulates are preferably dispersed for use. The resin particulates are used for the purpose of controlling a toner shape (peround, particle distribution, and others), and are mainly unevenly distributed on the surface of the formed toner particles. For the resin particulates, any resin can be used as long as the resin can form dispersoid in the water-based medium, and may be a thermoplastic resin or thermosetting resin. Examples are vinyl resins, polyurethane resins, epoxy resins, polyester resins, polyamide resins, polymide resins, silicon resins, phenol resins, melamine resins, urea resins, aniline resins, ionomer resins, and polycarbonate resins. These may be used singly or in combination of two or more. Of these, particularly preferable are vinyl resins, polyurethane resins, epoxy resins, polyester resins, or any combination thereof, because of the fact that water dispersants of fine-globular resin particles can be easily obtained. Examples of the vinyl resin include polymers obtained through single polymerization or compolymerization of vinyl monomers. Such polymers include, for example, styrene-(meta)acrylic ester copolymers, styrene-butadiene copolymers, (meta)acrylic acid-acrylic ester copolymers, styrene-acrylonitrile copolymers, styrene-maleic anhydride copolymers, and styrene-(meta)acrylic acid copolymers. The amount of dispersion and formulation of this resin particulates in the water-based medium is preferably 0.5 weight percent to 10 weight percent with respect to an organic solvent and, if not in that range, a failure in emulsification will occur to make granulation impossible. More preferably, the amount is 1 weight percent to 3 weight percent. The average particle diameter of the resin particulates is from 5 nanometers to 200 nanometers and preferably from 20 nanometers to 300 nanometers, in view of granulation. Also, in view of low-temperature fixability and toner conservation, a glass transition point (Tg) is preferably 40 degrees Celsius to 90 degrees Celsius and, more preferably in a range of 50 degrees Celsius to 70 degrees Celsius.

The toner using polyester resin is formed by dispersing an organic solvent phase containing polyester prepolymer in the water-based medium phase together with the amines to cause either one or both of elongation and crosslinking reactions in the water-based medium phase to form urea-modified polyester.

Polyester prepolymer, nonreactive polyester, the colorant or colorant masterbatch, the releasing agent, and the charge controlling agent are preferably dissolved or dispersed in advance in the organic solvent phase.

An example of a scheme of stably forming dispersant of the organic solvent phase and amines in water-based solvent is a scheme of dispersing by acting on shearing force. The dispersing scheme is not particularly restricted, and any known schemes, such as a low-speed shearing scheme, a high-speed shearing scheme, a friction scheme, a high-pressure jet scheme, and a ultrasonic scheme, can be applied. Also, as required, a dispersing agent can be used. Using a dispersing agent is more preferable in view of the fact that the particle size distribution is sharp and dispersion is stable. Examples of the dispersing agents include anioic surfactants, such as alkylbenzene sulfonic acid salts, a-olefin sulfonic acid salts, and phosphoric acid esters; cationic surfactants of a quaternary ammonium base, such as alkyl trimethyl ammonium acid salts, dialkyl dimethyl ammonium salts, and alkyl dimethyl benzyl ammonium salts; nonionic surfactants, such as fatty-acid amide derivatives and polyalcohol derivatives; and amphoteric surfactants, such as alanine, dodecyldi(aminoethyl) glycine and di(octelaminoethyl) glycine.

To remove an organic solvent from the obtained dispersion, a scheme is preferably used in which the temperature of the entire base is gradually increased for complete vaporization and removal of the organic solvent in the droplets.

Next, the embodiment is more specifically explained based on experiment examples.

First, the toner for use in the experiment examples is explained.

The toner for use in the examples and comparison examples was obtained in a manner as explained below.

A lacteous liquid was obtained by mixing and agitating 950 parts of water, 20 parts of water dispersion of vinyl resin (a copolymer of sodium salt of stylene-methacrylate-butyl acrylate-ethlene methacrylate oxide-additive sulfuric ester) (Sanyo Chemical Industries, Ltd.), 16 parts of a 48.5% water solution of dodecyldi phenyl ether disulfonate sodium (ELEMINOL MON-7 manufactured by Sanyo Chemical Industries, Ltd.), 12 parts of a 3.0% water solution of high-polymer-protective-colloid carboxymethyl cellulose (SEROGEN BSH manufactured by Sanyo Chemical Industries, Ltd.), and 130 parts of ethyl acetate. This is taken as a water phase. 1200 parts of water, 50 parts of carbon black (Reagal 400R manufactured by Cabot Corporation), and 50 parts of polyester resin (RS801 manufactured by Sanyo Chemical Industries, Ltd., a weight average molecular weight of 19,000, Tg of 64) were mixed, further in addition to 30 parts of water, by Henschel mixer (Mitsui Mining Co., Ltd.). The mixture was mulled with two rolls at 150 degrees Celsius for 30 minutes, was rolled for cooling, and was crushed by a pulverizer to obtain a carbon black mastermatch.

In a container with a mixing bar and a thermometer set therein, 500 parts of a polyester resin (RS801 manufactured by Sanyo Chemical Industries, Ltd., a weight average molecular weight of 19,000, Tg of 64), 30 parts of carnauba wax, and 850 parts of ethyl acetate were put, and the temperature was increased to 80 degrees Celsius while mixing, and was left and kept at 80 degrees Celsius for five hours, and was then cooled down to 30 degrees Celsius for one hour. Then, by using a beads mill (Ultra Visco Mill manufactured by AIMEX Co., Ltd.), wax was dispersed under the conditions: liquid sending speed of 1.2 Kg/hr; disk circumferential velocity of 8 m/sec; a filling amount of 0.5-millimeter zirconia beads of 80 volume percent; and the number of passes of three times. Next, 110 parts of the carbon black masterbatch and 500 parts of ethyl acetate were put in a container for mixing for one hour to obtain a dissolved product. Furthermore thereafter, 240 parts of ethyl acetate were added, and by using the beads mill, a dispersion was obtained under the following conditions: liquid sending speed of 1.2 Kg/hr; disk circumferential velocity of 8 m/sec; a filling amount of 0.5-millimeter zirconia beads of 80 volume percent; and the number of passes of three times. This was taken as an oil phase.

1780 parts of the oil phase, 100 parts of a 50% ethyl acetate solution of polyester prepolymer (Sanyo Chemical Industries, Ltd., number average molecular weight of 3800 and weight average molecular weight of 15,000, Tg of 60 degrees Celsius), 15 parts of isobutyl alcohol, and 7.5 parts of isophorone diamine were put in a container and, after being mixed by TK homomixer (Tokushu Kika Kogyou Co., Ltd.) for one minute at 6000 revolutions per minute, 1200 parts of water phase was added to the container. The resultant was mixed at 7,500 revolutions per minutes for twenty minutes to obtain a water-based medium dispersion.

In a container with a mixing bar and a thermometer set therein, the water-based medium dispersion was introduced and, after removal of the solvent at 30 degrees Celsius for 12 hours, was matured at 45 degrees Celsius for eight hours to obtain dispersion with the organic solvent being evaporated. 100 parts of this dispersion was decompressed and filtered, and then 500 parts of ion exchange water was added to a post-filtering cake, and then mixing was performed by TK homomixer (at 12000 revolutions per minute for ten minutes). Then again decompression and filtering were performed. Then, the filtering cake was dried by a circulation-wind dryer at 45 degrees Celsius for 48 hours. Then, a mesh with its opening being 75 micrometers was used for sieving to obtain a toner particle matrix.

100 parts by weight of the toner particle matrix obtained as explained above, 1.2 parts by weight of hydrophobic silica as an additive having an average primary particle diameter of approximately 12 nanometers (Clariant (Japan) K. K.), 0.5 parts by weight of hydrophobic titanium oxide having an average primary particle diameter of approximately 12 nanometers (Tayca Corporation), and 0.8 parts by weight of hydrophobic silica having an average primary particle diameter of approximately 120 nanometers (Shin-Etsu Chemical Co., Ltd.) were mixed by a Henschel mixer, and were caused to pass through a sieve with its opening of 38 micrometers to remove agglomerates to obtain a toner A.

The weight average particle diameter (D4) of the obtained toner A was 5.8 micrometers, the number-average particle diameter (Dn) was 5.1 microns, and the average peround was 0.97, the additive implantation ratio X was 42 percent.

The weight average particle diameter (D4) and the number-average particle diameter (Dn) were measured by using Coulter Multisizer II (Coulter Corporation). The measurement counts were set to 50,000 counts. In the following a measuring scheme is explained.

First, in an electrolytic aqueous solution of 100 milliliters to 150 milliliters, 0.1 milliliters to 5 milliliters of a surface-active agent (preferably, alkyl benzene sulfonate) was added as a dispersing agent. The electrolytic solution was formulated by using first-class sodium chloride to prepare approximately 1% NaCl aqueous solution. As the 1% NaCl aqueous solution, for example, ISOTON-II (Coulter Corporation) can be used. To the electrolytic solution, 2 milligrams to 20 milligrams of a measurement test sample were further added. The test-sample-suspended electrolytic solution was subject to a dispersion process for approximately one to three minutes at a ultrasonic disperser. Then, in the measuring device, with the use of 100-micrometer aperture as an aperture, the volume and number of the toner particles or toner were measured to calculate a volume distribution and a number distribution. From the obtained distributions, the weight average particle diameter (D4) and the number-average particle diameter (Dn) of the toner can be obtained.

Furthermore, the average peround was measured by using a flow-type particle image analyzer FPIA-2100 (Sysmex Corporation) for the measure of the ultra fine powder toner. Also, analytical software (FPIA-2100 Data processing Program for FPIA version 00-10) was used for analysis. Specifically, 0.1 milliliters to 0.5 milliliters of 10 weight-percent surface-active agent (alkyl benzene sulfonic acid neogen SC-A from Dai-ichi Kogyo Seiyaku Co., Ltd.) was added to a glass-made 100-milliliter beaker, were added with 0.1 grams to 0.5 grams of each toner, and were then mixed with a Micro Spatula. Next, 80 milliliters of ion exchange water was added. The obtained dispersion was then subjected to a dispersion process at a ultrasonic disperser (Honda Electronics) for three minutes. Then, the dispersion was put in FIPA-2100 and the toner shape and distribution were measured until the condensation of 5000 to 1500/microliter was obtained. In this measuring scheme, in view of measurement reproducibility of the average peround, it is important to set the dispersion condensation at 5000 to 15000/microliter. To obtain the dispersion condensation, the conditions of the dispersion, that is, the amount of the surface-active agent and the amount of toner to be added, have to be changed. The required amount of the surface-active agent is different depending on hydrophobicity of the toner, as is the case of the measurement of the toner particle diameter. If the added amount of the surface-active agent is large, noise by bubbles occurs. If the added amount is small, the toner cannot be sufficiently wet, resulting in insufficient dispersion. Also, the amount of added toner depends on the particle diameter. If the particle diameter is small, the amount is small. If the particle diameter is large, the amount should be large. When the toner particle diameter is 3 micrometers to 7 micrometers, 0.1 grams to 0.5 grams of the toner is added. With this, the dispersion solution condensation can be matched with 5000 to 15000/microliter.

The intermediate transfer belt 10 for use in the experiments was a single-layer seamless belt made of polyimide resin having a volume resistivity of $1\times10^{9}$ ohm centimeters and a surface resistivity of $1\times10^{11}$ ohms/square. For measuring the volume resistivity and the surface resistivity, Hiresta-UP (MCP-HT450) high resistivity meter and URS probe (MCP-HTP14) (Mitsubishi Chemical Corporation) were used.

[Experiment 1]

With the image forming apparatus 20, an overall primary transfer ratio including the amount of reverse transfer of each color with different primary transfer biases have been investigated. The result is shown in Table 4. The overall primary transfer ratio was measured as follows:

First, a plurality of single-color toner images each in a predetermine image shape are formed. As the image shape has a larger area, the measurement accuracy is higher, and is determined by a photosensitive member diameter. Next, the power supply is instantaneously interrupted with the toner images formed on the photosensitive member, and then the photosensitive unit is taken out of the mechanical body to absorb the toner image on the photosensitive member via a filter to measure an amount of attachment on the photosensitive member Kt. Next, a toner image is transferred onto the intermediate transfer belt, and power supply is also instantaneously interrupted after the toner image passes through the last primary transfer nip of the occasions of primary transfer even after the toner image passes through. Then, the intermediate transfer unit is taken out from the machine body. Then, the toner image on the intermediate transfer belt is absorbed via a filter to measure the amount of attachment on the intermediate transfer member Bt. Then, an overall primary transfer ratio including reverse transfer downstream is calculated from Kt and Bt. This measurement is performed for each color.

$$\text{Overall primary transfer ratio (\%)}=Bt1\times 100/Kt1$$

TABLE 4

| | | Comparison example 1 | Comparison example 2 | Comparison example 3 | Comparison example 4 | Example 1 | Example 2 |
|---|---|---|---|---|---|---|---|
| Primary transfer bias [μA] | Y | 30 | 34 | 26 | 30 | 30 | 34 |
| | M | 30 | 34 | 26 | 30 | 28 | 32 |
| | C | 30 | 34 | 26 | 30 | 26 | 30 |
| | K | 30 | 34 | 26 | 24 | 24 | 28 |
| Overall primary transfer ratio [%] | Y | 78 | 74 | 80 | 81 | 91 | 90 |
| | M | 84 | 80 | 85 | 87 | 91 | 91 |
| | C | 90 | 85 | 88 | 92 | 91 | 92 |
| | K | 95 | 94 | 90 | 88 | 90 | 94 |

As shown in Table 4, in any of Comparison example 1 where the primary transfer biases of the respective colors are equal, Comparison example 2 where the biases are increased from those in Comparison example 1, Comparison example 3 where the biases are decreased from those in Comparison example 1, and Comparison example 4 where only the last primary transfer bias is decreased, the overall primary transfer ratio of the Y color that is subjected first to primary transfer is 80 percent, which is a low level. On the other hand, in both Examples 1 and 2 where the primary transfer biases are sequentially decreased for the respective color components, the transfer ratio for each color is 90 percent or higher, indicating that the overall transfer ratio is improved. Since the Y color in Comparison example 1 and the Y color in Example 1 have the same primary transfer bias value, the transfer performances from the photosensitive member to the intermediate transfer belt are of a similar degree. However, compared with the overall primary transfer ratio of the Y color in Comparison example 1 being 72 percent, the overall primary transfer ratio in Example 1 is 91 percent. That is, as in Example 1, by controlling the primary transfer biases so that they are sequentially decreased for the respective colors, reverse transfer is decreased. Therefore, reverse transfer can be decreased by increasing the primary transfer bias of a color to be transferred onto the intermediate transfer belt first than the primary transfer biases of other colors

[Experiment 2]

Next, by using toners with different additive implantation ratios X, an experiment similar to the Experiment 1 was performed. The additive implantation ratios can be adjusted by adjusting the molecular weight of resin. For example, when a polyester resin (RS801 manufactured by Sanyo Chemical Industries, Ltd., weight average molecular weight of 19,000, Tg of 64 degrees Celsius) is changed to a polyester resin (Sanyo Chemical Industries, Ltd., weight average molecular weight of 12,000, Tg of 56 degrees Celsius), a toner can be obtained with a weight-average particle diameter (D4) of 5.7 micrometers, a number-average particle diameter (Dn) of 5.1 micrometers, an average peround of 0.98, and an additive implantation ratio of 56 percent. In this manner, by adjusting the molecular weight of resin, toners with additive implantation ratios of 38 percent, 42 percent, 56%, and 70 percent were prepared. Also, a styrene-acrylic resin was used as a resin. Furthermore, tones with additive implantation ratios of 30% and 38 percent were also prepared. Still further, fixability under a low-temperature and low-humidity environment was examined (10° C. 15%). In the evaluations of fixability, a fixability level of a multicolor-superposed solid image (with a maximum amount of adhered toner) formed on a transfer sheet was evaluated. In the evaluations of the fixability level, three ranks were used: a circle indicates "no problem", a triangle indicates "allowable limit", and a cross indicates "not allowable".

The result is shown in Table 5.

TABLE 5

| | | Comparison example 5 | Comparison example 6 | Comparison example 7 | Comparison example 8 | Comparison example 9 | Comparison example 10 | Example 3 | Example 4 | Example 5 |
|---|---|---|---|---|---|---|---|---|---|---|
| Additive implantation ratio [%] | | 30 | 38 | 38 | 42 | 56 | 70 | 42 | 56 | 70 |
| Toner resin | | Styrene-acrylic resin | Styrene-acrylic resin | Polyester resin | Polyester resin | Polyester resin | Polyester resin | Polyester resin | Polyester resin | Polyester resin |
| Primary transfer bias [μA] | Y | 30 | 30 | 30 | 30 | 30 | 30 | 34 | 34 | 34 |
| | M | 30 | 30 | 30 | 30 | 30 | 30 | 32 | 32 | 32 |
| | C | 30 | 30 | 30 | 30 | 30 | 30 | 30 | 30 | 30 |
| | K | 30 | 30 | 30 | 30 | 30 | 30 | 28 | 28 | 28 |
| Transfer ratio[%] (including reverse transfer) | Y | 88 | 85 | 84 | 78 | 75 | 72 | 90 | 87 | 85 |
| | M | 90 | 88 | 86 | 84 | 82 | 78 | 91 | 90 | 88 |
| | C | 92 | 92 | 91 | 90 | 91 | 83 | 92 | 90 | 90 |
| | K | 94 | 94 | 93 | 95 | 94 | 86 | 94 | 91 | 90 |

TABLE 5-continued

| | Comparison example 5 | Comparison example 6 | Comparison example 7 | Comparison example 8 | Comparison example 9 | Comparison example 10 | Example 3 | Example 4 | Example 5 |
|---|---|---|---|---|---|---|---|---|---|
| Fixability (10° C. 15%) | X | Δ | Δ | ○ | ○ | ○ | ○ | ○ | ○ |

As shown in Table 5, toners with an additive implantation ratio X smaller than 40 percent had a high overall primary transfer ratio even when the primary transfer biases of Y, M, C, and K were the same, compared with toners with an additive implantation ratio equal to or greater than 40 percent, but had insufficient fixability under the low-temperature low-humidity environment. Conversely, the toners with an additive implantation ratio equal to or greater than 40 percent had an excellent fixability under the low-temperature low-humidity environment; however, reverse transfer occurred in many toners, and the overall primary transfer ratio was equal to or smaller than 80 percent. That is, the toners with an additive implantation ratio equal to or greater than 40 percent are reverse-transfer-prone toners. Even for such reverse-transfer-prone toners with an additive implantation ratio equal to or greater than 40 percent, as can be seen from Examples 3, 4, and 5, the primary transfer biases are controlled to be sequentially decreased for the respective color components. Thus, reducing the amount of toner reversely transferred can be reduced and the overall primary transfer ratio can be improved.

As explained above, according to the embodiment, the intermediate transfer belt 10 with its surface potential attenuation ratio being equal to or smaller than half is used. Therefore, while the intermediate transfer belt is rotated once, the surface potential of the belt is excellently attenuated. With this, even if the second transfer bias onward (M, C, and Bk colors) are decreased from the first transfer bias for successive printing, a decrease in transferability of the M, C, and Bk colors after a predetermined number of sheets can be suppressed. Also, the primary transfer bias to be applied to the intermediate transfer belt at the time of a second primary transfer onward of a toner image onto the intermediate transfer belt is lower than the primary transfer bias at the time of a first primary transfer of the toner image onto the intermediate transfer belt. With this, charging the toner on the intermediate transfer belt is suppressed, and accordingly, reversely-charged toner and reversely-transferred toner can be reduced. Thus, an excellent image without irregularity can be achieved.

Furthermore, potential history of the previous image on the surface of the intermediate transfer belt disappears from the time when the toner image is transferred onto a transfer sheet for secondary transfer by the time when the first primary transfer bias is applied. Thus, the potential history of the previous image does not hinder the transfer of the next image. Therefore, it is possible to suppress an inconvenience such that, at the time of the next image formation, a residual image of the toner image at the time of the previous image formation occurs on the toner image transferred onto the transfer sheet for secondary transfer.

Still further, the primary transfer biases to be applied to the primary transfer rollers of the M, C, and Bk colors are set to be sequentially decreased. With this, if transferability is decreased to decrease the amount of attachment on the intermediate transfer belt, the primary transfer bias of the color on the upstream side in the belt moving direction with a large amount of reverser-transfer toner in which the overall primary transfer ratio is significantly decreased can be set so as not to fall out of a peak range of the transfer ratio as much as possible. Therefore, it is possible to suppress a decrease, due to environmental fluctuations, in overall transferability of the color on the upstream side in the belt moving direction with a large amount of reverse-transfer toner. As a result, even if environmental fluctuations occur, for example, a decrease in overall transfer ratio can be suppressed, and image quality can be reliably maintained.

The toner for primary transfer onto the intermediate transfer belt first passes through transfer nips the largest number of time. Therefore, the amount of reverse-transfer toner is large. This decreases the amount of adhered toner, and an abnormal image with irregularity tends to occur. However, a yellow toner image in which an image failure, such as irregularity, tends to be inconspicuous, is set to be the first to be transferred onto the intermediate transfer belt. Therefore, even if an image failure, such as irregularity, occurs, such an abnormal image can be made inconspicuous.

Further, black toner, which is less superposed on a toner image on the intermediate transfer belt, is not influenced by the primary transfer electric field due to resistance of the toner image on the intermediate transfer belt. Therefore, compared with magenta toner and cyan toner, which are often superposed on a toner image on the intermediate transfer belt, transferability of black toner is not much influenced even if the primary transfer bias is set to be small. Therefore, black toner capable of suppressing the primary transfer bias the lowest is lastly transferred onto the intermediate transfer belt for primary transfer, which effectively suppresses reverse transfer of other three color toners.

Still further, a Y toner image, an M toner image, and a C toner image are transferred onto the intermediate transfer belt in this order. With this, even if part of toner on the lowest layer among the toner images superposed on the intermediate transfer belt is not adhered to a transfer member at the time of secondary transfer and is left as residual transfer toner, it is possible to suppress errors such as irregularity in an image that occur due to a decrease in the amount of adhered toner on the uppermost layer among the toner images superposed on the transfer member.

Still further, with the intermediate transfer belt having a single-layer configuration, potential attenuation can be made excellent compared with the one having a plurality of layers. Therefore, the surface potential of the intermediate transfer belt can be excellently attenuated before the intermediate transfer belt reaches the next primary transfer nip. Thus, weakening of the primary transfer electric field due to the surface potential of the intermediate transfer belt can be suppressed.

Still further, with the volume resistivity of the intermediate transfer belt being equal to or greater than $1\times10^{8}$ ohm centimeters and equal to or smaller than $1\times10^{11}$ ohm centimeters, an erroneous image with transfer dust can be suppressed. Also, the potential attenuation ratio of the intermediate transfer belt can be equal to or smaller than half.

Furthermore, toner having an additive with an additive implantation ratio equal to or greater than 40 percent is used. Therefore, the toner can be melt at a low temperature, and fixing energy can be reduced. In addition, polyester resin excellent in low-temperature fixability is used as binding resin for the toner. With this, the fixing temperature can be decreased. Thus, power saving of the image forming apparatus can be achieved.

As set forth hereinabove, according to an embodiment of the present invention, the intermediate transfer member has a surface potential attenuation ratio such that a residual potential of a portion of the intermediate transfer member with 500 volts applied thereto becomes equal to or lower than 250 volts after five seconds. Therefore, during a period from when the toner image is transferred onto to a transfer sheet for secondary transfer until a first primary transfer bias is applied, the surface potential of the intermediate transfer member increased due to a primary transfer electric field is excellently attenuated. With this, even if successive printing is performed, it is possible to suppress an increase in the potential of the surface of the intermediate transfer belt, which suppresses weakening of the primary transfer electric field acting on the transfer nip due to the influence of the surface potential of the intermediate transfer belt. As a result, a second transfer bias onward is lowered than the primary transfer bias. Thus, even in the case of successive printing, it is possible to prevent a decrease in transferability of the second toner image onward after a predetermined number of printings. Also, with the second transfer bias onward being lowered than the primary transfer bias, the charging to the toner on the intermediate transfer member can be suppressed, whereby reverse charge of toner and reverse transfer of toner can be reduced.

Furthermore, with the surface potential attenuation ratio of the intermediate transfer member being as such, the potential history of the previous image on the surface of the intermediate transfer member disappears after the toner image is transferred onto the transfer sheet for secondary transfer to the time the first primary transfer bias is applied. Therefore, the potential history of the previous image does not hinder the next image transfer, and an inconvenience can be suppressed such that a residual image of the toner at the time of the previous image formation occurs on the toner image transferred onto the transfer sheet for secondary transfer at the time of the next image formation.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries toner images; and an intermediate transfer member onto which the toner images are primarily transferred, sequentially from a first toner image, from the image carrier to form a superposed toner image to be secondarily transferred onto a transfer member, wherein the intermediate transfer member is applied with different levels of primary transfer bias upon primary transfer of the toner images, a level of primary transfer bias applied upon primary transfer of the first toner image is higher than a level of primary transfer bias applied upon primary transfer of other toner images, and the intermediate transfer member has a surface potential attenuation ratio such that residual potential of the intermediate transfer member applied with a voltage of 500 volts becomes equal to or lower than 250 volts after five seconds.

2. The image forming apparatus according to claim 1, wherein the primary transfer bias is sequentially lowered in level as the toner images are sequentially transferred onto the intermediate transfer member.

3. The image forming apparatus according to claim 1, wherein a black toner image is last, among the toner images, to be primarily transferred onto the intermediate transfer member.

4. The image forming apparatus according to claim 1, wherein the first toner image is a yellow toner image.

5. The image forming apparatus according to claim 4, wherein a magenta toner image is second, among the toner images, to be primarily transferred onto the intermediate transfer member, and a cyan toner image is third, among the toner images, to be primarily transferred onto the intermediate transfer member.

6. The image forming apparatus according to claim 1, wherein the image carrier includes a plurality of image carriers, and upon primary transfer of the toner images, the toner images are sequentially transferred from the image carriers onto the intermediate transfer member.

7. The image forming apparatus according to claim 1, wherein the intermediate transfer member is a belt-shaped member with a single-layer structure.

8. The image forming apparatus according to claim 1, wherein a volume resistivity of the intermediate transfer member is equal to or greater than $1\times10^{8}$ ohm centimeters and equal to or smaller than $1\times10^{11}$ ohm centimeters.

9. The image forming apparatus according to claim 1, wherein toner for forming the toner images includes toner base particles that contains a binding resin and a colorant, and an additive with a saturated additive implantation ratio equal to or greater than 40 percent is externally added to surfaces of the toner base particles.

10. The image forming apparatus according to claim 9, wherein the binding resin is a polyester resin.

* * * * *